United States Patent [19]

Krilov

[11] Patent Number: 4,640,327

[45] Date of Patent: Feb. 3, 1987

[54] ULTRA HIGH PRESSURE WATER LOG DEBARKING

[75] Inventor: Alexandre Krilov, New South Wales, Australia

[73] Assignee: The Minister for Industry and Decentralization of the State of New South Wales, Sydney, Australia

[21] Appl. No.: 715,937

[22] Filed: Mar. 25, 1985

[30] Foreign Application Priority Data

Oct. 17, 1984 [AU] Australia ..... PG7689

[51] Int. Cl.[4] ..... B27L 3/00

[52] U.S. Cl. ..... 144/340; 144/208 D

[58] Field of Search ..... 144/208 R, 208 D, 341, 144/342, 340

[56] References Cited

U.S. PATENT DOCUMENTS 2,576,861 11/1951 Shaw et al. ..... 144/208 D
2,709,465 5/1955 Hansel ..... 144/208 D
2,765,012 10/1956 Riddel et al. ..... 144/208 D
3,942,565 3/1976 Ratelle et al. ..... 144/208 D
4,047,549 9/1977 Ratelle et al. ..... 144/208 D

*Primary Examiner*—W. D. Bray
*Attorney, Agent, or Firm*—Laubscher & Laubscher

[57] ABSTRACT

A method and apparatus for hydraulically debarking logs is disclosed, in which water at a substantially constant, ultra high pressure of, say, at least 25,000 KPa, is caused to impinge upon, generally radially with respect to, the surface of a log to be debarked. The apparatus of a preferred embodiment has ultra high pressure nozzles mounted upon resilient members circumferentially surrounding the log to be debarked, the members being biassed radially inwardly of the leg to bear upon the undulating surface thereof, and to maintain the nozzles at a predetermined distance therefrom, thereby maintaining the impinging water at a constant ultra high pressure.

2 Claims, 6 Drawing Figures

FIG. 1
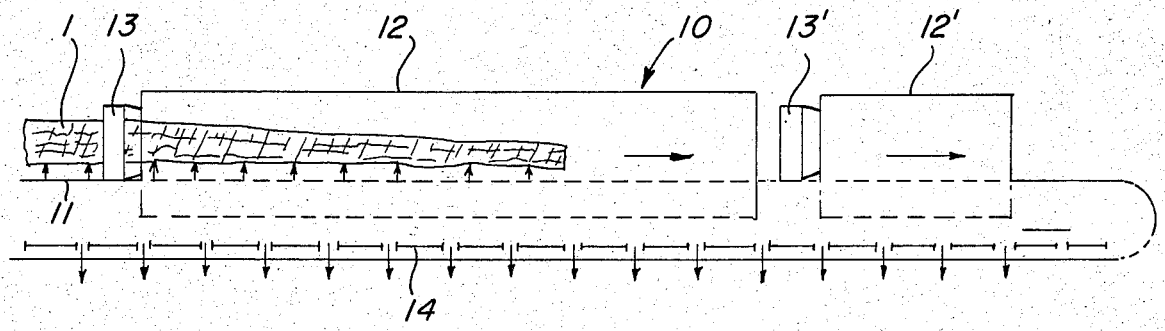
FIG. 2
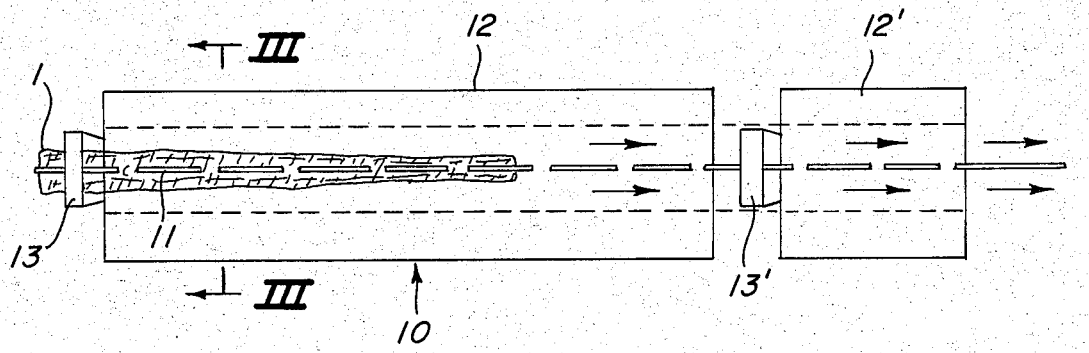
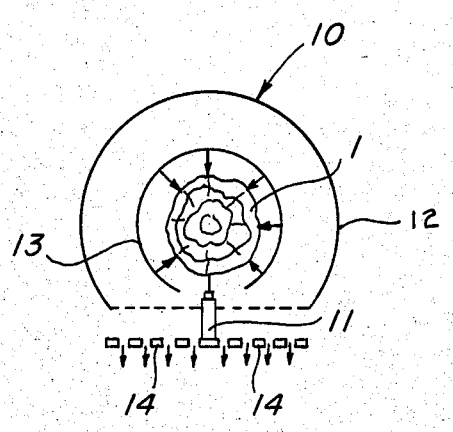
FIG. 3

FIG. 5
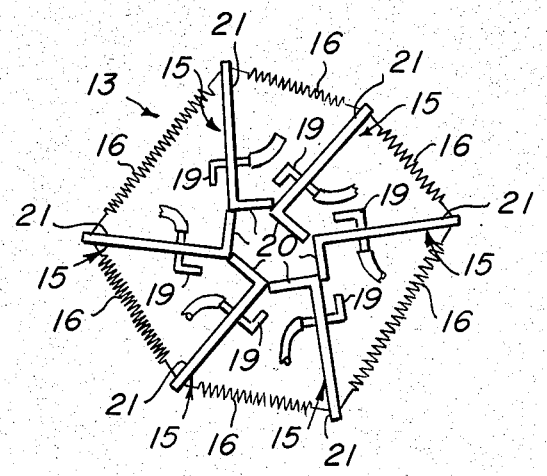
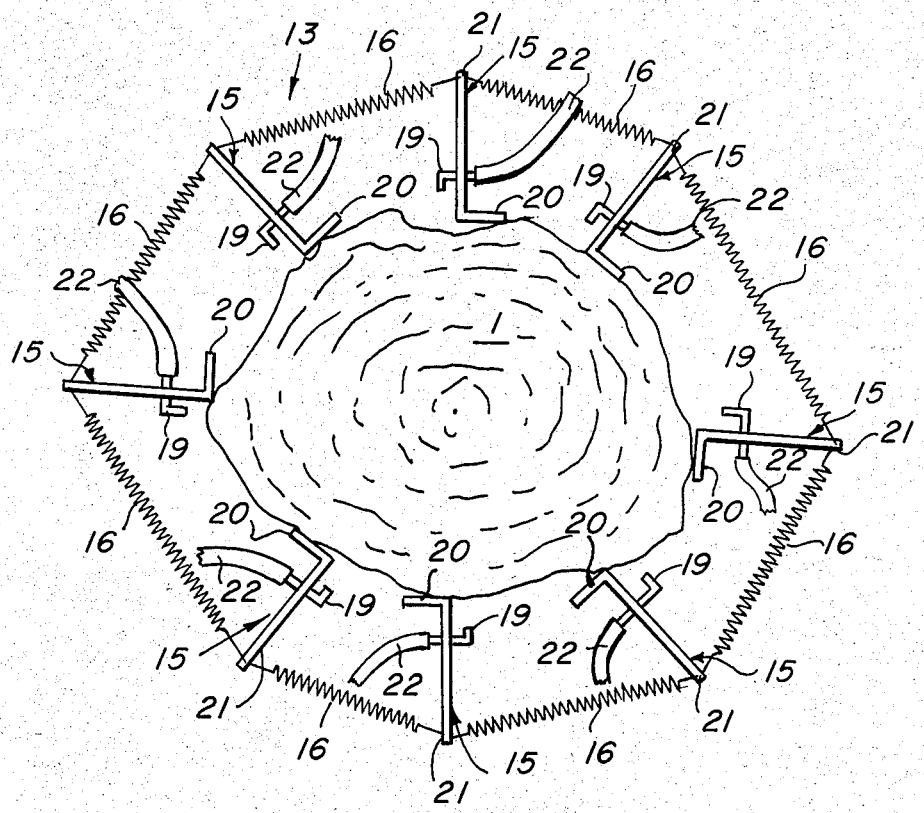
FIG. 6

ULTRA HIGH PRESSURE WATER LOG DEBARKING

BACKGROUND OF THE INVENTION

This invention relates to a method of and an apparatus for debarking logs.

Due to an increasing shortage of large timber, substantial quantities of small-sized timber, and particularly hardwoods, are gradually emerging from anomynity as a distinctive and marketable commodity, as discussed in a paper entitled "Debarking of Eucalypts—A reappraisal". by A Krilov, and published in Aust. For. J43(4) 1980—145-149. These new types of raw material, which have previously received little attention, are expected to form a much more important part of the world's timber supply in the near future.

The cost of debarking large quantities of small, low volume timber, such as hardwoods, of poor configuration by conventional means, is ofter prohibitive. One way of achieving this cheaply and efficiency would be to use an appropriately designed hydraulic debarker.

BRIEF DESCRIPTION OF THE PRIOR ART

A known hydraulic debarking technique uses high pressure water jets to loosen and then remove bark from logs. Small logs of poor shape can be debarked cleanly and without excessive damage, which is not otherwise possible without removing a certain amount of good fibre. Such equipment, however, requires a larger water supply and is generally restricted to operations of a considerable size. Hydraulic debarkers can handle softwoods and numerous hardwoods well, particularly those with thin bark. However, they cannot effectively handle difficult hardwood species which also cannot generally be debarked by standard mechanical debarkers.

Certain timbers, which in the present state of technology are considered to be extremely difficult to debark, include *Eucalyptus paniculata* which has a massive and very hard bark, *E. pilularis* and *Syncarpia glomulifera* with short to medium fibrous bark which adheres strongly to the cambial layers and long-fibre species, such as, *E. agglomerata* belonging to the botanical group of "true" stringybarks.

The known use of high pressure water for log debarking and/or surface preparation or cleaning normally involves pressures of up to 20,700 kPa.

An object of the invention is to provide a method of and apparatus for debarking timber which can effectively handle difficult hardwood species, such as those mentioned above, as well as efficiently debarking such timber in large quantities of small, low volume hardwoods of poor configuration with which known high pressure hydraulic debarkers cannot cope efficiently.

Another object of the present invention is to provide a method of and apparatus for debarking timber, which reduces substantially the amount of water otherwise used in known forms of high pressure or other forms of debarkers.

SUMMARY OF THE INVENTION

Accordingly, one aspect of the invention provides a method of hydraulically debarking logs, wherein water at a substantially constant, ultra high pressure, of, for instance, at least 25,000 kPa, is caused to impinge upon and generally radially with respect to the surface of a log to be debarked.

In accordance with another aspect of the invention, there is provided a hydraulic debarking apparatus including means for causing water to impinge upon and generally radially with respect to the surface of a log to be debarked at a substantially constant, ultra high pressure, of, for instance, at least 25,000 kPa.

The substantially constant, ultra high pressure of the water impinging generally radially on the log surface can be of the order of 83,000 kPa, although lower pressures down to, say, 25,000 kPa, may be used successfully, depending upon the nature of the logs to be debarked.

In a preferred embodiment of the invention, the means for causing the substantially constant, ultra high pressure water to impinge generally radially on the surface of a log to be debarked comprises at least one ultra high pressure nozzle which is maintained at a predetermined radial distance from the surface of the log during debarking, thereby maintaining the ultra high pressure of the water impinging generally radially upon the log surface at a substantially constant and desired value.

In this preferred embodiment, each ultra high pressure nozzle is maintained at a predetermined distance from the surface of the log durng debarking by resilient means which bears against the log surface and to which each nozzle is fixed. Thus, as the profile of the log surface varies, according to its natural growth, the resilient means moves radially inwardly and outwardly with respect to the log surface upon which it bears, thereby maintaining each nozzle at a predetermined distance from the undulating log surface. As a consequence, the ultra high pressure of the water impinging generally radially upon the log surface is maintained substantially constant.

Each ultra high pressure nozzle may be rotatable around the log, in a plane generally normal to the longitudinal axis thereof, during debarking. Alternatively, the log can be rotated about its own axis with respect to the or each nozzle.

BRIEF DESCRIPTION OF THE FIGURES

A preferred embodiment of ultra high pressure water debarking apparatus, in accordance with the invention and for carrying out a method according thereto, will now be described by way of example and with reference to the accompanying drawings in which:

FIG. 1 is a diagrammatic side elevation of an ultra high pressure hydraulic debarking apparatus;

FIG. 2 is a diagrammatic top plan of the apparatus of FIG. 1;

FIG. 3 is a diagramatic cross-section of the apparatus of FIGS. 1 and 2, taken along the line III—III in FIG. 2.

FIG. 5 is a diagrammatic end view of the nozzle arrangement shown in FIG. 4, in its non-working position; and FIG. 6 is a diagrammatic end view of the arrangement shown in FIG. 5, in its working position.

DETAILED DESCRIPTION

Figure 4:
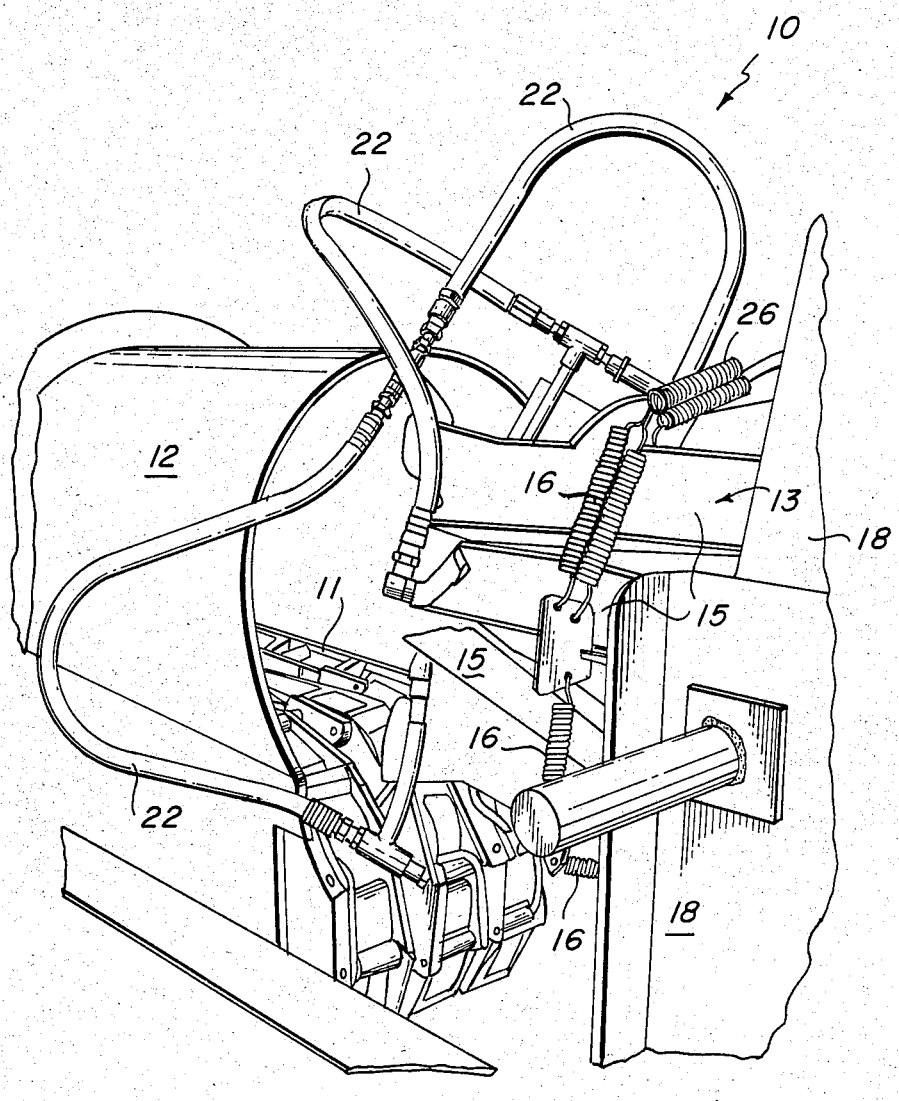
FIG. 4 is a perspective side view of the apparatus of FIGS. 1 to 3, showing a nozzle arrangement in more detail.

Referring now to the drawings, an ultra high pressure hydraulic debarking apparatus, designated generally at 10, is designed to operate with tree-length logs 1 of 100 to 350 mm diameter and a maximum length of 30 m. Prior to being fed individually to the debarking apparatus 10, the logs 1 are loaded on to a "waterfall" or "cascade" type unscrambler deck (not shown) consisting of three sections which can be controlled individually. The log feed speed varies from 6.8 m/min on deck one to 18 and 25 m/min on deck two and three respectively. A rotating log loader (not shown) places each log separately on to a chain conveyor 11 which feeds each log to the input at the left hand end of the apparatus 10.

Before describing the particular form of the hydraulic debarking apparatus 10, some basic principles of fluid mechanics will now be considered in relation to achieving efficient practical application of water blasting techniques to the removal of the bark from the logs during their passage through the debarking apparatus. These principles govern the "debarking power" which can be applied when such factors as jet velocity, nozzle size, engine power and water delivery volume are specified. These and other factors are related to each other by equations whose solutions lead to the attainment of a correct balance of such factors, which, in turn, achieves debarking of the logs without causing any substantial surface breakdown of the timber. The following equation is of basic importance:

$$F=p\cdot V^2$$

where

F=debarking or impact force (Pa)

V=velocity of the fluid (m/s)

p=fluid mass density.

This equation relates the velocity of the water jet delivered through a nozzle directly to the pressure of the fluid and nozzle orifice. It is important to recognise this relationship, because the desired pressure can only be achieved by the proper combination of nozzle orifice and pump volume. This can be illustrated as follows.

Where a TC No. 5 nozzle operating at 531/min will produce a pressure of 45,500 kPa, the same volume of water expelled through a TC No. 4 nozzle will develop 58,600 kPa, namely, 13,000 kPa more, using the same pump and engine. Most standard Triplex pumps used in water blasting today are capable of delivering 20 to 70 l/min at ultra high pressures which range from 27,000 to 69,000 kPa and sometimes reach 83,000 kPa.

Another consideration of prime importance is the size of engine driving the pump. If the engine does not have sufficient power, then obviously pressure volume cannot be maintained. This is expressed by another simple but important relationship, namely,:

$$kW=P\cdot V/C^T$$

where

P=pressure at the nozzle (kPa)

V=volume of fluid (l/min)

$C^T$=constant appropriate to the equipment used

There is always a pressure drop between the pump and the nozzle, which depends upon a number of factors, the main ones being the size and length of hose used. Tables providing the technical characteristics of such hoses are available and it is important to use them, because the water blasting process may be a failure if the incorrect hose is fitted.

Another factor of considerable importance in determining the effects of the water jets is the angle of incidence which is the angle of impact measured between each jet and the surface of the log. A range of such angles could vary between 90° and 5°, in this particular application the most effective angle of incidence being 60°.

During use of the apparatus 10 on a *pinus elliottii* log, the importance of a substantially constant spacing between the nozzles and the log 1 to be debarked can be demonstrated. It has been found that there is an optimum distance for this factor which has to be kept constant, or at least substantially constant, during debarking. The actual distance required varies with the species of timber and the need to maintain this constant nozzle distance presented at one time a substantial practical problem, because of the variable sizes of the logs and the fast rate of feed through the debarking apparatus 10.

To solve this problem, a novel component of the apparatus 10 was designed and built, the completed component's structure being a strongly made framework shaped in the form of a deep tapered, generally circular, open-ended basket-type cradle 13 with axially-extending, heavy duty metal bars 15 which are pivoted at the wider axial open end. This cradle 13 is fixed horizontally in the mouth of an "anti-thrash" tunnel 12. The wider open end of the cradle 13, into which each log 1 is fed longitudinally, narrows to a diameter at its other open end which is equal to a minimum log diameter size, because each bar 15 is urged radially inwardly by a bias provided by tensioned springs 16. The ends of the bars are curved slightly radially outwardly and eight jet nozzles are attached to each of them at predetermined locations. This ensures that, whatever the log size the ultra high pressure water strikes the log surface from the optimum distance of, say, 80 mm, in the particular case of *pinus elliottii* logs. In operation, logs 1 are conveyed through the cradle 13 to the downstream end of the cradle and log sections of minimum diameter pass under the jets without altering the size of the framework. Larger log sections force the bars radially outwardly, but because the spring bias keeps the bias 15 in constant contact with the log surface, the nozzles 19 maintain the correct distance from the log surface. This ingenious arrangement provides excellent working results.

In more detail, and with particular regard to FIGS. 4 to 6 of the drawings, the axially-extending bars 15 are mounted, for radial pivotal movement at the upstream wider open end of the cradle 13, upon a framework 18, as shown in FIG. 4. At the other, downstream end of the cradle 13, each bar 15 is provided with at least one radially inwardly directed nozzle 19. Each bar 15 is generally L-shaped with its shorter leg 20 arranged to bear against the surface of a log 1 to be debarked. The radially extending, longer legs 21 of adjacent pairs of bars 15 are connected together, at their outer ends, by the strongly tensioned springs 16 which bias the bars 15 radially inwardly, such that the shorter legs 20 of the bars are maintained in bearing contact with the surface of the log 1. Each nozzle 19 of each bar 15 is mounted on the longer leg 21 thereof, to be directed radially inwardly towards the log surface. Ultra high pressure water is supplied to the nozzles via suitable hoses 22. In this preferred embodiment, there are eight bars 15, although only six are shown in FIG. 5, for reasons of clarity.

In the non-working position of the cradle 13, as shown in FIGS. 4 and 5, the bars 15 are located in their radially innermost positions, owing to the radially inward bias of the tension springs 16. When a log 1 to be debarked is passed through the cradle 13, as shown in FIGS. 1 to 3 and 6, the bars 15 are urged radially outwardly due to the shorter legs 20 thereof bearing upon the surface of the log. As the log 1 continues its passage through the cradle 13 upon the conveyor 11, the bars 15 are resiliently moved radially inwardly and outwardly in dependence upon the shorter legs 20 bearing against the undertaking surface of the log. In this way, the nozzles 19 are maintained at a substantially constant distance from the log surface, thereby maintaining the water impinging thereupon at a substantially constant, ultra high pressure to cause the required debarking of the log 1. As described above, the debarked log 1 then progresses downstream through the anti-thrash tunnel 12.

The debarked logs 1 are conveyed at a speed of 60 to 70 m/min through the anti-thrash tunnel 12, where a further series, preferably eight, of ultra high pressure water jets blast away any extraneous bark or other material remaining on the log surface. The jets are regulated to provide pressures of approximately 48,300 kPa which was found to be the most effective value for this particular debarking apparatus, although pressures of 69,000 kPa can be achieved with suitable motors, for instance, a three phase 415 volt power supply or a diesel engine. The volume of water used averages 227 l/min.

The ultra high pressure water is projected at a velocity of 396 m/s through No. 6 ring-type nozzles which have 1.5 mm openings and a 15° fan. The water is delivered from a motor driven pump 30.

In this particular water blasting arrangement, there is preferably a safety factor of 3:1 for the hoses and fittings and 4:1 for the nozzles. The jets are regulated automatically and the nozzles safety stop for machine pressure is controlled by an operator.

The waste bark material removed from the logs by the ultra high pressure water jets is deposited under gravity on to a wide belt conveyor 14 which takes it to any suitable waste disposal area. Also, any chunks of thick bark can be collected periodically from underneath the waterfall or cascade deck and transferred to a central waste pile (not shown).

At the foundation level of the apparatus 10, used water from the ultra high pressure debarking method flows under gravity in to an open concrete drain (also not shown) which channels it through a series of gratings into a sediment trap (not shown) where large pieces of solid waste are filtered from the water. It is then pumped up to a head station (not shown) from which it flows slowly through a series of settling ponds down to a main water holding pond. In the settling ponds, the remaining dirt and fines soon fall to the bottom and the water is finally clarified by using a flocculating agent, preferably, "Actizyme" (additive K) which is added periodically at the rate of 25 kg per million liters of water used. The total cost of this additive is negligible.

The "clean" water from the main water holding pond is then pumped up to a storage tank and subsequently fed by gravity to the nozzles through suitable filters. This recycling system, therefore, solves the two problems of high water usage and accelerated machinery wear. So successful has been the recycling process, that water losses, monitored over a considerable period, have been not more than 2% of the total water throughput, such losses mainly being due to evaporation.

As can be seen from FIGS. 1 and 2, an additional anti-thrash tunnel 12' can be located downstream of the first anti-thrash tunnel 12. This further tunnel 12' can also be provided with ultra high pressure water nozzles and a suitable cradle arrangement 13' as in the case of upstream tunnel 12.

A number of trials employing the inventive apparatus and method have been carried out and these are detailed in the following Example.

EXAMPLE

Timber

Several short logs ranging between 65 and 140 mm mid-diameter were cut from the following five species: Ironbark (*E. paniculata*), blue-leaved stringybark (*E. agglomerata*) white mahogany (*E. acmenioides*), blackbutt (*E. pilularis*) and turpentine (*Syncarpia glomulifera*). Three samples of each species were collected and provided a gradient of debarking difficulty, due mainly to the different thickness of bark. Samples dimensions, bark characteristics and relevant observations are noted in Table 1.

All samples were harvested in the shortest possible time (within 24 hours), marked, hermetically enclosed within polythene bags and prepared for testing the next day.

TABLE 1

| | | 3 | 4 | 5 | 6 | 7 | 8 | | |
|---|---|---|---|---|---|---|---|---|---|
| | | Dimensions | | | | | | | |
| 1 | | Diameter | | | | Thickness | | | |
| Sample | 2 | top | butt | Length | Volume | top | butt | 9 | 10 |
| No. | Timber species | mm | mm | m | $m^3$ | mm | mm | Bark type | Observations |
| 1 | *E. paniculata* | 130 | 140 | 1.26 | 0.018 | 10 | 10 | Massive & ridged, | Top branches from a large |
| 2 | *E. paniculata* | 75 | 90 | 1.86 | 0.010 | 10 | 10 | hard | fallen tree; |
| 3 | *E. paniculata* | 85 | 85 | 1.38 | 0.008 | 8 | 8 | | very dry, knotty and hard |
| 4 | *E. agglomerata* | 115 | 125 | 1.25 | 0.014 | 10 | 12 | Long stringy | Top branches from tree with |
| 5 | *E. agglomerata* | 85 | 85 | 1.17 | 0.007 | 6 | 8 | | 400 mm butt diameter |
| 6 | *E. agglomerata* | 70 | 75 | 1.36 | 0.006 | 7 | 8 | | |
| 7 | *E. acmenioides* | 125 | 130 | 1.20 | 0.015 | 10 | 10 | Short stringy | Small tree with 150 mm |
| 8 | *E. acmenioides* | 95 | 105 | 1.03 | 0.008 | 7 | 9 | | butt diameter |
| 9 | *E. acmenioides* | 65 | 75 | 1.26 | 0.005 | 6 | 7 | | |
| 10 | *Syncarpia glomulifera* | 120 | 140 | 0.92 | 0.012 | 10 | 10 | Coarsely fibrous, | Small tree with 200 mm |
| 11 | *Syncarpia glomulifera* | 105 | 115 | 1.15 | 0.011 | 15 | 16 | thick, furrowed | butt diameter |
| 12 | *Syncarpia glomulifera* | 115 | 125 | 1.50 | 0.017 | 12 | 13 | | |
| 13 | *E. pilularis* | 140 | 165 | 1.04 | 0.019 | 8 | 10 | Finely fibrous, | Small tree with 400 mm |
| 14 | *E. pilularis* | 125 | 150 | 0.95 | 0.014 | 7 | 10 | stringy | butt diameter |
| 15 | *E. pilularis* | 90 | 130 | 0.90 | 0.009 | 7 | 8 | | |
| 16 | *E. paniculata* | 105 | 115 | 1.02 | 0.010 | 12 | 14 | as above | Top branches from a |
| 17 | *E. paniculata* | 120 | 120 | 0.97 | 0.011 | 15 | 15 | | fallen tree of 500 mm |

TABLE 1-continued

| 1 Sample No. | 2 Timber species | 3 Dimensions Diameter top mm | 4 Diameter butt mm | 5 Length m | 6 Volume $m^3$ | 7 Thickness top mm | 8 Thickness butt mm | 9 Bark type | 10 Observations |
|---|---|---|---|---|---|---|---|---|---|
| 18 | *E. paniculata* | 100 | 120 | 0.97 | 0.009 | 10 | 16 | | butt diameter |

Equipment

The equipment consisted of:

(a) An American Aero anti-corrosive, stainless steel high-pressure pump, model FE85 Triplex, capable of three outputs, which were easily adjustable in practice:

| Pressure kPa | Maximum flow l/min |
|---|---|
| 69,000 | 37.8 |
| 48,300 | 53.0 |
| 34,500 | 71.9 |

The pump power ends were heat-treated, alloy steel crankshafts, with large bearings for high frame load capacities. The connecting rods were made of nodular iron and fitted with precision-type split insert bearings and extra-large hardened and ground wrist pins. The piston-type crossheads were over-sized for reduced wear. The simplified design permitted complete field maintenance by semi-skilled personnel.

All piping connections were straight boss threads with SAE O-ring seals to eliminate stress and prevent leakage. The pump was fitted with a 138,000 kPa pressure gauge and safety relief valve, set to open at 20% above maximum machine discharge pressure. At a safety factor of 3:1 the pump was stressed against accidents to some 1.2 million kPa.

(b) A movable two-stroke Detroit Diesel Allison, model WBD-90, fitted with a supercharged engine type GMC 3-53 Diesel running at 2000–2100 RPM, necessary to operate the high-pressure pump.

(c) Single operator control gun model P-10-M, fitted with the appropriate nozzle, and designed for pressures not greater than 69,000 kPa.

Trials Testing Procedure

Whilst each log was securely fixed before debarking began, the hydraulic pump was adjusted to the medium range pressure of 48,300 kPa. At this pressure it was capable of developing a maximal flow of 53 l/min.

To reduce water losses, the control gun was fitted with a stainless steel No. 6 jet nozzle with 15° fan and 1.57 mm diameter opening. At a relatively high pressure (48,300 kPa), this nozzle produced a water flow of not greater than 28.4 l/min.

Debarking of each sample was timed. The number of passes per log were counted and the debarking time per strip noted. As pump-nozzle flow capacities were known, this information enabled the water requirements per species to be determined. It also provided a fair indication of the relative difficulty of bark removal from the samples.

Results

The final results of the debarking trials are given in Table 2, as follows:

TABLE 2

| 1 Sample No. | 2 Timber species | 3 Debarked length m | 4 Debarking time Per strip S | 5 Debarking time In normal operation $S^a$ | 6 Total volume of water used l | 7 Volume of water required to debark 1 mm length l | 8 Observations |
|---|---|---|---|---|---|---|---|
| 1 | *E. paniculata* | + | — | — | — | — | +Sample used to adjust system. No times were taken |
| 2 | *E. paniculata* | 1.00 | 7-11-11-17-19 | 13 | 24.5 | 24.5 | Both values only indicative: |
| 3 | *E. paniculata* | 1.38 | 15-17-19-22 | 18 | 34.0 | 24.6 | extremely dry, weather-hardened Sample |
| 4 | *E. agglomerata* | 1.25 | 6-6-10-10-11-12-13-17 | 11 | 20.7 | 16.5 | Bark is detached in long strips of various length. Adherance of the |
| 5 | *E. agglomerata* | 1.17 | 5-8-9-9-10-12 | 9 | 17.0 | 14.5 | inner bark great. No particular |
| 6 | *E. agglomerata* | 1.36 | 7-8-9-10 | 9 | 17.0 | 12.5 | problems |
| 7 | *E. acmenioides* | 1.20 | 6-7-7-7-7-7-10-10 | 8 | 15.1 | 12.5 | Bark is detached in short, separate fibers of 200–300 mm. Adherance |
| 8 | *E. acmenioides* | 1.03 | 7-7-8-10-11 | 9 | 17.0 | 16.5 | of the inner bark similar to |
| 9 | *E. acmenioides* | 1.26 | 5-5-5-5 | 5 | 9.4 | 7.4 | previous. No problems |
| 10 | *Syncarpia glomulifera* | 0.92 | 3-3-4-4-5-7-7 | 5 | 9.4 | 10.2 | Debarking easy. Bark is detached |
| 11 | *Syncarpia glomulifera* | 1.15 | 5-6-7-7-10-10 | 8 | 15.1 | 13.1 | in long (up to 1.00 m) and wide |
| 12 | *Syncarpia glomulifera* | 1.50 | 7-8-8-8-13-15 | 10 | 18.9 | 12.6 | (50–100 mm)strips or small chunks. Wood surface clean |
| 13 | *E. pilularis* | 1.04 | 3-4-5-7-7-8-9-9-10-10-11-12-12 | 9 | 17.0 | 16.3 | Debarking difficult. Great adherance of bark falling-off in |
| 14 | *E. pilularis* | 0.95 | 5-6-9-11-11-12-12-13-13-13-15-16 | 12 | 22.6 | 23.7 | tufts similar to *E. acmenioides.* Wood surface unclean, irregular |
| 15 | *E. pilularis* | 0.90 | 5-7-13-13-14-14-14-15-16 | 13 | 24.5 | 27.2 | and extensively damaged by spray |
| 16 | *E. paniculata* | 1.02 | 5-7-9-14 | 9 | 17.0 | 16.6 | Relatively easy debarking. Bark is |
| 17 | *E. paniculata* | 0.97 | 7-7-10-10-12 | 10 | 18.9 | 19.4 | detached in large, solid chunks. |
| 18 | *E. paniculata* | 0.97 | 7-8-12-14 | 11 | 20.7 | 21.3 | similar to Syncarpia. Greater volume of water is necessary to |

TABLE 2-continued

| 1 Sample No. | 2 Timber species | 3 Debarked length m | 4 Debarking time Per strip S | 5 Debarking time In normal operation S[a] | 6 Total volume of water used l | 7 Volume of water required to debark 1 mm length l | 8 Observations |
|---|---|---|---|---|---|---|---|
| | | | | | | | carry off thick bark |

*Rounded to the next top value

Note that in Table 2, column 4 represents debarking times clocked separately for the number of strips or passes needed to debark a given sample cleanly. These preliminary tests were carried out with only one jet nozzle, so that in a normal operation with a regular log feed the expected debarking time should be an average of the figures given in column 4. This value is noted in column 5.

The total volume of water delivered, which was necessary to debark a green sample, is given in column 6. It was calculated by multiplying the average time used in a normal operation (column 5) by four. The factor four represents the number of jets required for debarking logs of small to medium diameter in normal practice. As the results obtained correspond to the variable length of each sample, these figures were adjusted to a basic reference length of 1.00 m for each timber species (column 7)

Analysis of column 7 in Table 2 shows clearly that the species tested can be arranged in an order of difficulty of debarking, which is given in Table 3 (Note that *E. paniculata* samples 2 and 3 are excluded, as they were special cases), as follows:

TABLE 3

| 1 Sample No. | 2 Timber species | 3 Mean water consumption per 1.00 m length l | 4 Relative difficulty of bark removal[a] | 5 Observations |
|---|---|---|---|---|
| 10–12 | *Syncarpia glomulifera* | 11.9 | 1 | |
| 7–9 | *E. acmenioides* | 12.1 | 2 | |
| 4–6 | *E. agglomerata* | 14.5 | 3 | |
| 16–18 | *E. paniculata* | 19.1 | 4 | Standard sample |
| 13–15 | *E. pilularis* | 22.4 | 5 | |
| 1–3 | *E. paniculata* | 24.5 | Not considered | Extreme case |

[a]1 easy; 5 difficult

The conclusions of Table 3, column 4 are confirmed, qualitatively and quantitatively by practical observations.

One of the objects of this trial was to assess the feasibility of debarking certain timbers, which are known to be difficult in this respect. The results given above show that this object was achieved, and that debarking by means of an ultra-high pressure water jet is clearly practicable. These findings are numerically represented and commented upon in columns 7 and 8 of Table 2.

The specific example of *E. paniculata* extremely dry, weather-hardened samples No. 1, 2 and 3, selected to test the eventual capability of a hydraulic debarker in dealing with an extremely difficult bark under the worst possible conditions, is obvious. All these samples were debarked neatly and without too many problems. The practical experiments with other species only amplified and confirmed this fact.

The volume of water required to debark these timbers is not excessive. In fact, it is substantially less than that currently used by conventional hydraulic debarkers processing softwoods. It seems important, however, to note, that the estimations given in Table 2, column 7, do not necessarily represent the total volume of water which would be required for debarking one meter of any particular species in practice. In a closed circuit, supplied with an adequate filtering system, a small hydraulic debarker should be capable of limiting water losses to not more than 20% of the indicated values.

The behavior of various bark types under a high velocity water jet is different for each species. It has been observed that the shredding which occurs, is related to the specific structure of the bark and its adherence to the cambial layer. These factors also have a great influence on the average water consumption per unit length of sample (Table 3, column 3). The effect of variable log diameters, which is reflected to some extent by the number of passes per sample, is of a lesser importance and therefore is not considered further.

A number of observations on the behavior of the bark during debarking operation, is provided in Table 2, column 8. These observations show that the shredding qualities of Sample No.'s 4–6, 7–9, 10–12 and 16–18 bark types are basically different and that the shredding of bark fibers is characteristic for each particular timber species.

Thus, it is to be noted that Sample No.'s 7–9 bark type is cleanly separated by the water jet into individual fibers of short length (200–300 mm). The physical aspect of this bark and the degree of defibration are such, that the product obtained is readily utilizable. This material seems to have a great potential for the manufacture of a cheap insulating board.

In contrast, the bark type of *E. agglomerata* was removed in long strips of varying length, which could be used for such purposes as land fill.

The bark type of *E. paniculata* came off in solid chunks. These were quite regular in appearance and should have been usable as they were, for mulch, ground cover and other purposes. *Syncarpia glomulifera* chunks were somewhat longer.

Whilst most of the selected species were debarked well and with relative ease, *E. pilularis* presented a few problems. The separation of the bark from the wood was extremely difficult. It did not break down either into smaller pieces of characteristic shape or into separate fibers. Unlike other species, blackbutt bark was not entirely removed by the first pass of the jet: the inner bark hung down in torn fragments, while the other bark stuck out in hairy tufts, mixed with splinters from the damaged surface of the wood. Subsequent passes increased the damage to the log surface, without wholly removing the bark. The damage to the wood was such, that no attempt was made to remove all the bark by repeated application of the jet. The surface resulting from this treatment was rather unclean, irregular and more or less severely battered. The contrast between this species and the others tested, was very striking.

These results indicated clearly that at given nozzle characteristics, the pressure of 48,300 kPa was too high for this particular species.

It is, however, premature to conclude that *E. pilularis* cannot be efficiently debarked by hydraulic means, in that a lower water jet pressure, combined with a more suitable nozzle size and an adjusted nozzle geometry, may solve this problem.

Further improvements may be achieved by appropriate modifications in water flow pressure, number of nozzles, nozzle size, shape of the jet opening and the degree of the spray fan.

In this respect it is possible to reduce the total water consumption for debarking to about 20% of that used previously, by adequate removal of waste particles. Pollution control could be incorporated at the filtering stage of this process without any inconvenience.

Conclusions

These trials have allowed certain conclusions to be drawn as to the technical advance provided by the present invention which can be summarized as follows:

1. A clear demonstration that most of the small diameter hardwoods selected can be efficiently debarked by an ultra high pressure water jet. Even the most recalcitrant timber species, such as long fibered "stringybarks" can be debarked, which cannot be done by standard mechanical equipment. It is expected, therefore, that the majority of less problematic hardwood barks can be removed efficiently by this inventive method.

2. Timbers tested can be ranked in order of the difficulty of removal of their bark.

3. Although the cleanness of the debarked surface varies greatly within the range of species tested, the quality of debarking is far superior to that produced by other known equipment of any sort.

4. The fibers of certain bark types, such as that of *E. acmeniodides* or *E. paniculata,* are removed by the water jet in a form which should be utilizable without any further processing. Significant progress towards greater utilization of hardwood barks is made possible by these findings.

It is to be appreciated that, although the embodiment described above, with reference to the accompanying drawings, relies upon the resilient radial movement of the bars 15 to maintain the nozzles 19 at a predetermined distance from the surface of a log 1 to be debarked, thus maintaining the impinging debarking water at a substantially constant, ultra high pressure, other suitable means may be provided to maintain the ultra high pressure of the water at a constant value as it impinges on the log surface. For instance, radially inwardly biassed sensors may be used on the cradle to determine the undulating profile of the log surface at any given time and to adjust the pressure of the water issuing from the nozzles, which could be fixed upon the cradle, and with respect to the log surface, thereby maintaining the pressure of the water impinging upon the log surface at a substantially constant value.

Modifications may be made in this invention without departing from the scope and spirit thereof. While the invention has been shown and described in terms of certain particular structures and arrangements, the invention is not to be limited to those particular structures and arrangements except insofar as they are specifically set forth in the following claims.

What is claimed is:

1. A method of hydraulically debarking logs, comprising the step of directing water generally radially onto the surface of a log to be debarked at a substantially constant ultra high pressure of at least 25,000 kPa.

2. A method as defined in claim 1, wherein the water is directed against the log by a plurality of ultra high pressure nozzles, each of said nozzles being maintained a predetermined radial distance from the log surface during debarking thereof.

* * * * *